US007261343B2

(12) United States Patent
Ramsauer

(10) Patent No.: US 7,261,343 B2
(45) Date of Patent: Aug. 28, 2007

(54) BOLT WITH A HANDLE

(76) Inventor: Dieter Ramsauer, Max-Klein-Strasse 10, D-58332 Schwelm (DE)

( * ) Notice: Subject to any disclaimer, the term of this patent is extended or adjusted under 35 U.S.C. 154(b) by 0 days.

(21) Appl. No.: 10/479,126

(22) PCT Filed: May 25, 2002

(86) PCT No.: PCT/EP02/05772

§ 371 (c)(1),
(2), (4) Date: Sep. 1, 2004

(87) PCT Pub. No.: WO03/004814

PCT Pub. Date: Jan. 16, 2003

(65) Prior Publication Data

US 2005/0001436 A1 Jan. 6, 2005

(30) Foreign Application Priority Data

May 29, 2001 (DE) ..... 201 08 954 U

(51) Int. Cl.
*E05B 3/08* (2006.01)
*E05C 19/10* (2006.01)

(52) U.S. Cl. ..... 292/336.3; 292/100; 292/200; 292/304; 292/DIG. 11; 292/DIG. 68

(58) Field of Classification Search ..... 292/336.3, 292/194–196, 121, 200, 96, 108, 210, 219, 292/304, DIG. 11, 95, 98, 100, 126, 124, 292/197, DIG. 68
See application file for complete search history.

(56) References Cited

U.S. PATENT DOCUMENTS

| | | | | |
|---|---|---|---|---|
| 14,741 | A * | 4/1856 | Anderson | 362/181 |
| 37,625 | A * | 2/1863 | Hyde | 292/121 |
| 86,686 | A * | 2/1869 | Peterson | 292/121 |
| 161,050 | A * | 3/1875 | Metz | 292/56 |
| 558,972 | A * | 4/1896 | Meyer | 292/98 |
| 739,410 | A * | 9/1903 | Goerk | 292/336 |
| 767,567 | A * | 8/1904 | Keil | 292/127 |
| 848,034 | A * | 3/1907 | Husemann | 292/122 |
| 930,534 | A * | 8/1909 | Cox | 292/78 |
| 1,415,104 | A * | 5/1922 | Meyer | 292/11 |
| 1,479,655 | A * | 1/1924 | Evans | 292/108 |

(Continued)

FOREIGN PATENT DOCUMENTS

| | | |
|---|---|---|
| DE | 655 092 | 12/1937 |

(Continued)

*Primary Examiner*—Carlos Lugo
(74) *Attorney, Agent, or Firm*—Reed Smith LLP

(57) ABSTRACT

A rod closure for locking sheet-metal cabinet doors or doors or flaps, having a rod, which is profiled in an elongated manner, extends substantially edgewise parallel to the door edge and is preferably arranged in the bevel space, and a holding element which is arranged at the door frame for holding the rod so as to lock the door in the closed position, and an actuating device for the rod, which actuating device is connected to the door leaf. The rod or a complicated profiled rod is mounted so as to be swivelable between a locked position and an unlocked position around a longitudinal axis arranged close to the side directed away from the door leaf plane, and the holding element forms a contact surface for the other side of the rod facing the door leaf plane, and the actuation device engages the rod close to this side.

8 Claims, 6 Drawing Sheets

U.S. PATENT DOCUMENTS

| | | | | | |
|---|---|---|---|---|---|
| 1,490,874 | A | * | 4/1924 | Webb | 292/210 |
| 1,664,576 | A | * | 4/1928 | Stuart et al. | 292/127 |
| 1,797,765 | A | * | 3/1931 | Harrison | 292/256 |
| 1,815,690 | A | * | 7/1931 | Wiley | 292/200 |
| 1,995,106 | A | * | 3/1935 | Roedding | 292/226 |
| 2,021,957 | A | * | 11/1935 | Gregg | 292/113 |
| 2,028,954 | A | * | 1/1936 | Roedding | 292/126 |
| 2,203,341 | A | * | 6/1940 | Roedding | 292/336.3 |
| 2,657,085 | A | * | 10/1953 | Dedoes | 292/169 |
| 2,948,560 | A | * | 8/1960 | Rop | 292/45 |
| 2,978,757 | A | * | 4/1961 | Ammerman | 49/449 |
| 3,161,923 | A | * | 12/1964 | Crain | 292/128 |
| 3,722,927 | A | * | 3/1973 | Miska | 285/317 |
| 4,099,757 | A | * | 7/1978 | Palmer et al. | 292/336.3 |
| 4,212,410 | A | | 7/1980 | Galer | |
| 4,502,715 | A | * | 3/1985 | Lundblade | 292/78 |
| 4,632,440 | A | * | 12/1986 | Adrian et al. | 292/229 |
| 4,674,777 | A | | 6/1987 | Guelck | |
| 4,703,963 | A | * | 11/1987 | Ball | 292/336.3 |
| 4,739,896 | A | * | 4/1988 | Moss | 52/169.6 |
| 4,764,648 | A | * | 8/1988 | Resh | 200/50.1 |
| 5,286,073 | A | * | 2/1994 | Ui | 292/216 |
| 5,292,191 | A | * | 3/1994 | Slivon | 312/332.1 |
| 5,632,517 | A | * | 5/1997 | Paulik et al. | 292/341.12 |
| 5,713,614 | A | * | 2/1998 | Anderson | 292/336.3 |
| 6,428,075 | B2 | | 8/2002 | Kamemizu et al. | |
| 6,431,615 | B1 | * | 8/2002 | Bastian | 292/80 |
| 6,547,289 | B1 | * | 4/2003 | Greenheck et al. | 292/126 |
| 6,811,119 | B1 | * | 11/2004 | Petersen et al. | 244/114 R |
| 6,951,318 | B1 | * | 10/2005 | Petersen et al. | 244/114 R |

FOREIGN PATENT DOCUMENTS

| | | | |
|---|---|---|---|
| DE | 42 10 586 | | 10/1993 |
| DE | 4309620 | * | 9/1994 |
| DE | 298 10 023 | | 9/1998 |
| EP | 0 067 075 | | 12/1982 |
| EP | 0 261 268 | | 3/1988 |
| EP | 0 630 439 | | 1/1996 |
| GB | 744580 | | 12/1956 |
| GB | 2 170 547 | | 8/1986 |
| JP | 2001-260968 | | 9/2001 |

* cited by examiner

BOLT WITH A HANDLE

CROSS-REFERENCE TO RELATED APPLICATIONS

This application claims priority of International Application No. PCT/EP02/05772, filed May 25, 2002 and German Application No. 201 08 954.8, filed May 29, 2001, the complete disclosures of which are hereby incorporated by reference.

BACKGROUND OF THE INVENTION a) Field of the Invention

The invention is directed to a rod closure for locking sheet-metal cabinet doors or the like doors or flaps in sheet-metal cabinet frames or the like door frames or housing frames, comprising a rod, such as a flat strip rod, which is profiled in an elongated manner, extends substantially edgewise parallel to the door edge at the door or at the frame and is preferably arranged in the bevel space, and at least one holding element which is arranged at the door frame or at the door for holding the profiled rod so as to lock the door in the closed position, and an actuating device for the profiled rod, which actuating device is connected to the door or to the frame.

b) Description of the Related Art

A rod closure of this kind is substantially already known, e.g., from EP 0 261 268 A1. Further, reference is had to DE 42 10 586 A1.

In the known rod closures, the actuation of the locking rod is carried out by axial displacement of this locking rod.

The disadvantage in this kind of locking by means of axial displacement of a locking rod consists on one hand in that the drive mechanism of the rod is complicated and on the other hand in that the rod must support or form special locking elements. In DE 42 10 586 A1, these special locking elements are rotating portions on the locking rod; in EP 0 261 268 A1 they are running rollers which are arranged on the rod.

OBJECT AND SUMMARY OF THE INVENTION

It is the primary object of the invention to provide a rod closure of the type mentioned in the beginning in which the locking rod need not form or carry any special locking elements. Further, the locking function of the locking rod should not require axial displacement of this rod.

This object is met in accordance with the invention in that the profiled rod, such as a flat strip rod, is mounted so as to be swivelable between a locked position and an unlocked position around a longitudinal axis arranged close to the side of the elongated profile directed away from the door leaf plane, in that the holding element forms a contact surface for the other side of the elongated profile of the rod facing the door leaf plane, and in that the actuation device engages the profiled rod close to this side.

This step does away with axial displacement of the locking rod, so that complicated transmission devices for transforming the movement of a hand lever, either a rotational movement or swiveling movement or some other movement, into an axial displacement of the locking rod can be eliminated. Further, locking elements need no longer be arranged or formed on the rod, so that manufacture of the locking rod is limited to sawing off a piece of the profile rod to an appropriate length corresponding to the cabinet height.

In some cases, the ends of the rod are to be rounded off so as to improve pivoting bearing support.

However, a bearing support of the locking rod, particularly when it is a flat strip rod, can also be carried out in a very simple manner in that the profiled rod is received in a partially circular or triangular receiving space of a rod guide element.

In order for the rod, such as a flat strip rod which need only comprise a severed piece of flat strip material, to be held in the rod guide element, e.g., inside the door leaf bevel area, either the profiled rod can be slid through axially or, if this is to be avoided, the rod guide element can be constructed, for example, as a structural component part which can be clipped onto a welded stud or the like according to a further embodiment form of the invention.

Since an axial displacement within guide elements need no longer take place after the rod is mounted, a profiled rod which has not been finished or deburred is sufficient, although this could normally not be used due to the high axial sliding friction and would have to be deburred and finished.

The rod guide element can comprise a spring device which pushes the rod into the locked position. The closure rod accordingly forms a kind of latch which makes it possible to push the door leaf against the door frame and accordingly lock the closure without actuating the closure.

The actuating arrangement can comprise an actuating device, e.g., a lever, which is supported around an axis parallel to the door leaf plane and which swivels into the open position against the force of the spring, or a spring, when the profiled rod is actuated. An actuating lever of this kind can be lockable, e.g., outfitted or not outfitted with a lock. A particularly simple design results when the actuating arrangement comprises a lever which reaches through an opening in the door leaf and which is rigidly connected, e.g., clamped, to the profiled rod. This eliminates the need for a special bearing support of the hand lever on the door leaf because this bearing support is taken over by the profiled locking rod. An additional handle for actuating the door may be provided in addition to this actuating lever.

The actuating device can be the tongue of a sash lock.

Also, for a simple construction the holding element arranged at the door frame is constructed as a steel angle. In particular, it is possible in this way to combine a rod closure of the type according to the invention with hinge devices requiring bore holes, openings or threaded bore holes in the frame which are also available in an analogous manner for fastening the steel angle. This has the advantage that the door leaf can be turned around without changing the hole configuration in the frame, so that a door hung on the left-hand side can be converted to a right-handed door.

Alternatively, the holding element can also be a locking pin (pivoting part).

Further, in order to reduce noise and lessen the leverage required for the process of swiveling the door, the rod guide element is advantageously made of plastic.

The same goals are achieved when the profiled rod, such as a flat strip rod, is provided with a clip enclosure of plastic material in the area of the swivel bearing.

According to another embodiment form, the profile of the rod can be U-shaped, wherein one leg forms or carries a hook or terminates in a hook and this leg or the other leg terminates in a circular or teardrop shape which is received in a square or partially circular receiving space of a rod guide element formed by a beveled bearing plate and is held therein by means of spring force.

In particular, the profile of the rod can have an actuating projection which is arranged at the outer side of the U or is formed by one leg thereof. It is advantageous when the profile of the rod in this embodiment form is held by leaf springs which also push the rod profile or its actuating projection in the closing direction. To facilitate mounting, the leaf spring can have a catch projection for preassembly. This rod can be injection molded from metal or plastic.

BRIEF DESCRIPTION OF THE DRAWINGS

The invention will be described more fully in the following with reference to embodiment examples shown in the drawings.

DESCRIPTION OF THE PREFERRED EMBODIMENTS

Figure 1:
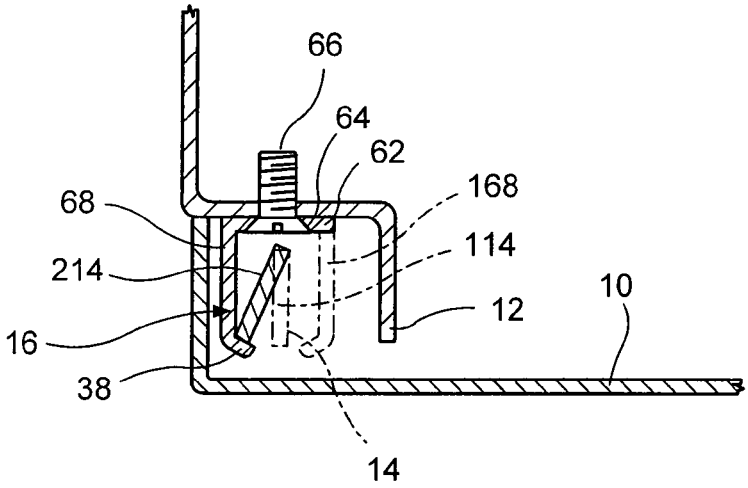
FIG. 1 is a sectional view showing a rod closure of the type according to the invention with a door frame and a door leaf of sheet-metal.

FIG. 1 shows a cross-sectional view of a sheet-metal cabinet door 10 which is articulated at a door frame 12 in a manner not shown in more detail. Alternatively, this may be a flap 10 which locks an opening formed by the frame 12. A flat strip rod 14 which is arranged parallel to the door edge or flap edge substantially edgewise to the door plane or flap plane is used for locking the door or flap in the closed state. According to the view shown by solid lines in FIG. 1, this flat strip rod 14 engages a holding element 16 arranged at a door frame 12 and accordingly prevents the door from being opened.

The flat strip rod 14 can be swiveled (rotated) out of this closed position shown in solid lines in FIG. 1 into an open position shown in dashed lines, in which position it releases the holding element 16 so that it is possible for the door to be swung out.

Figure 2:
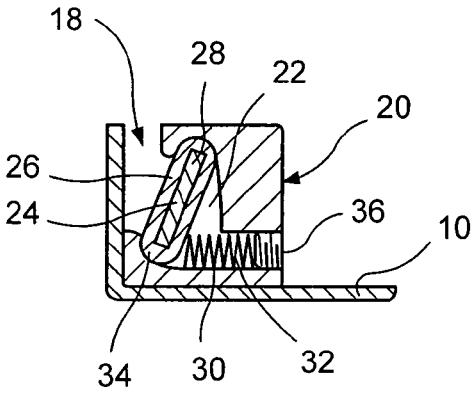
FIG. 2 is a sectional view showing a rod guide element which is arranged in the bevel space of a door leaf and has a partially circular receiving space for the rod, including a spring.

To enable these two positions of the flat strip rod shown in FIG. 1, that is, the closed position and open position, a rod guide element 20 can be provided, for example, according to FIG. 2, in the bevel area 18 of the door leaf 10. This rod guide element 20 has a partially circular or triangular receiving space 22 in which the rod cross section 24, including a plastic enclosure 26 if desired, can be received in such a way that the vertex of the triangle or the center point 28 of the partial circle becomes the axis of a swiveling movement for the flat strip rod 14.

FIG. 2 further shows that the guide element 20 is provided with a bore hole 30 which is preferably provided with a thread and which receives a helical pressure spring 32 in such a way that one (left-hand) end of the spring 32 presses against the swivelable end 34 of the flat strip rod cross section 24, that is, into the closed position shown by the solid lines in FIG. 1. A stud screw 36 prevents the spring 32 from sliding out of the bore hole 30 and, at the same time, is used for adjusting the pressing force of the spring (by screwing and unscrewing the stud screw 36).

The spring makes it possible to deflect the cross section of the flat strip rod 14 when closing the door leaf 10, in which case the bent tip 38 swivels the flat rod out of the closed position shown by solid lines in FIG. 1 into the open position shown by dashed lines until the cross section is released again after achieving the intended end position of the door leaf and is pressed into the closed position shown in FIG. 1, specifically by the force of the spring 32. To this extent, the flat rod closure acts as a latch lock in this case.

Figure 3:
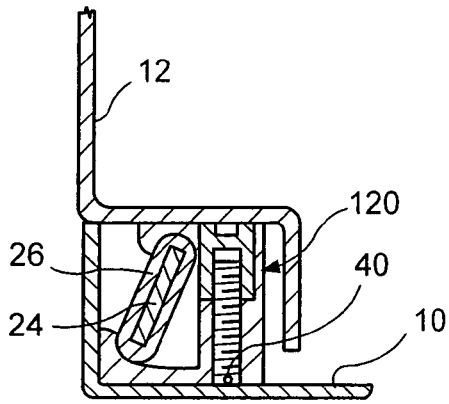
FIG. 3 is a sectional view of the bevel space which is formed between a door frame and a door leaf and within which is arranged the rod guide with a swiveling element that can be clipped in and secured to the door leaf by a welded stud fastening.
Figure 4:
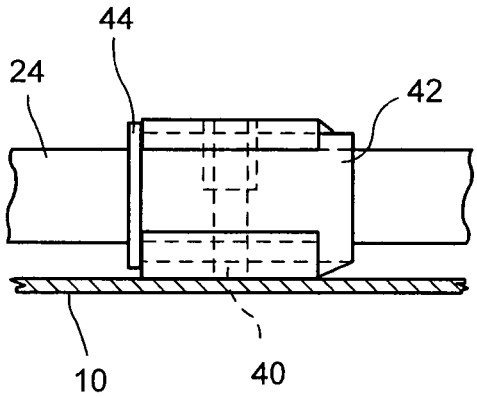
FIG. 4 is a side view of the rod guide shown in FIG. 3.

The guide element 20 can be secured in the position shown in FIG. 2 by gluing to the corner area of the door leaf 10. Another alternative is shown in FIG. 3, wherein a welded stud 40 is spot-welded to the sheet-metal of the door leaf 10; a swiveling element 120 which can be clipped in can be placed on the welded stud 40 can again be supported so as to be swivelable around the cross section 24 in the manner described above, possibly with the enclosure 26 made of plastic. FIG. 4 is a sectional view from the left-hand side of the arrangement according to FIG. 3 showing the enclosure of the flat strip rod 24, in this case by a swiveling element 42 made from plastic such as polyamide. On the one hand, this swiveling element ensures that the swiveling can be carried out without generating noise (such as squeaking) and, on the other hand, that friction is extensively prevented during the swiveling process. Also, a stop is formed by a bead or ring 44 and contacts the edge of the rod guide 120 so that an axial displacement is prevented in one direction. Another rod guide with a swiveling element that can be clipped in is advisably arranged in such a way that an axial displacement is prevented in the other direction. Therefore, the flat strip rod 24 can only carry out a swiveling movement, but not an axial sliding movement. Usually, only one ring 44 is sufficient to prevent a sliding movement, that is, when this sliding movement would only be brought about by the force of gravity of the rod.

Figure 5:
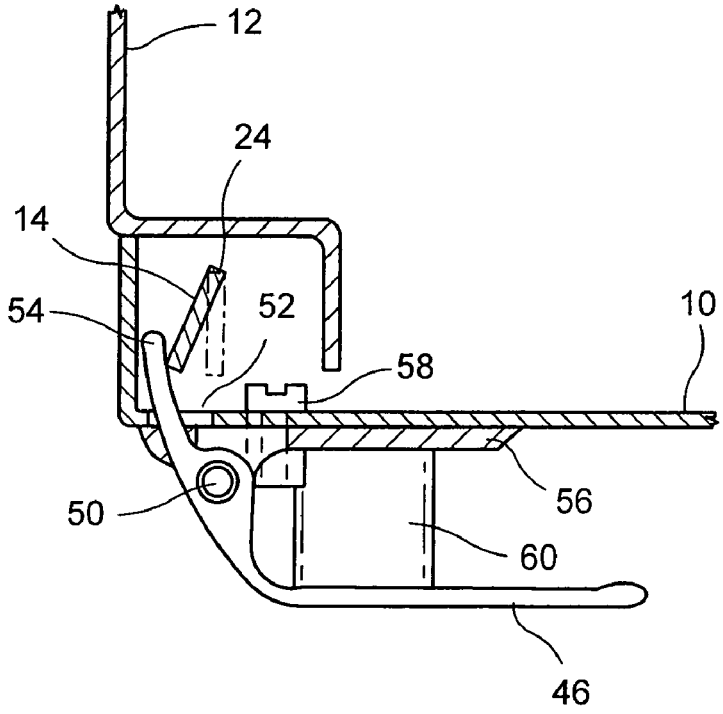
FIG. 5 is a schematic view of an actuating lever with a bearing support device on the door leaf, including a lock.

According to FIG. 5, an actuating device with an actuating lever 46 which is mounted around an axis or pin 50 parallel to the door leaf plane serves to move the flat strip rod out of the locked position according to FIG. 1 to FIG. 5, specifically, into the open position shown in dashed lines. By swiveling the hand lever 46 around the pin 50 in clockwise direction according to FIG. 5, the inner lever end 54 extending through an opening 52 in the bevel space up to the flat strip rod 24 presses the movable end of the flat strip rod 24 in the counterclockwise direction and, therefore, into the open position.

The bearing support for the hand lever 46 can be formed by a trough 56 which can be placed, e.g., glued or screwed, on the door leaf 10 and which can be secured to the door leaf 10, e.g., by means of adjusting screws or cap screws 58. Further, with respect to the hand lever cover 40, FIG. 5 shows a cylinder lock 60 which locks the hand lever 46 in the shown position in a manner that is not shown in more detail when the cylinder 60 is rotated into the locked position.

Figure 6:
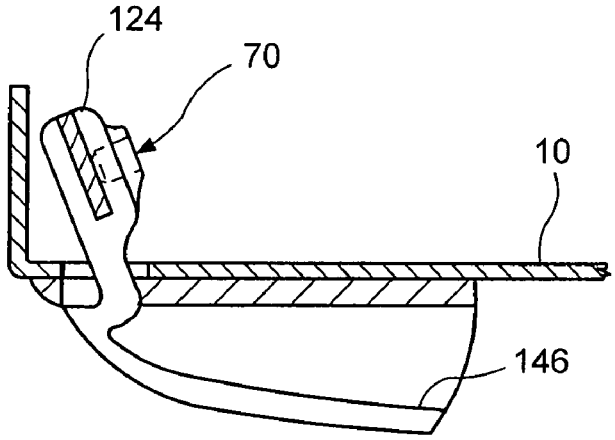
FIG. 6 is a view similar to that shown in FIG. 5 showing an actuating lever which is supported on the actuating rod.

The holding element 16 which can be seen in FIG. 1 comprises an angle with a base leg 62 with one or preferably two or more countersunk bore holes 64 through which countersink screws 66 can be inserted, which latter can be screwed into a corresponding thread in the frame 12. This arrangement also enables the alternative arrangement of the angle 16, whereby the leg device 68 carrying the hook arrangement 38 reaches the position which is shown in dashed lines FIG. 1 and designated by 168. In this mirror-symmetric arrangement, a corresponding different arrangement of the flat rod 124 would also be carried out (see FIG. 6), where the closed position is reached by swiveling in the counterclockwise direction. In this case, the actuating lever 146 is rigidly clamped with the flat rod 124 by means of a cap screw 70 so that its rod 124 also constitutes the bearing support for the hand lever 146 and a bearing support is not required on the door leaf.

Other embodiment forms are described in the following in which the rod closure works with a swivelable rod which does not have a simple rectangular flat rod profile but, rather, a more complicated shape as can be seen, for example, in FIG. 7B. The profile is substantially U-shaped, one leg of the U-profile 224 shown in FIG. 7B forming a hook (see reference number 81) which tapers to a point, while the other leg terminates in a circular or teardrop shape 82. The circular or teardrop shape 82 is received in a square or partially circular receiving space 222 formed by a beveled bearing plate 220 and is held there by spring force 132. The rod profile 224, or leg profile, is unfinished continuously over the entire height of the door leaf and is therefore cheaper to manufacture. The rod guide element 220, on the other hand, is formed over some portions as bearing plates which are secured to the door leaf 10 by spot welding 84. A leaf spring 132 has a "stable" or rigid end 86 which prevents the profile 224 in the bearing plate 220 from sliding out, but allows a limited swiveling movement. In contrast, the other end 88 of the leaf spring 132 is "soft" or elastic, i.e., has a smaller spring constant. This part 88 of the spring 132 presses the hook 81 into the closed position which can be seen in FIG. 7A. In this closed position, the hook 81 engages behind a closing pin 72 (a pivoting part) which may be screwed 96 together with the door frame 12. In order to open the closure, the swiveling profile 224 must be rotated in the counterclockwise direction in some manner, for example, by means of an opener handle 246 which is clipped on to the swiveling profile at an axial location between two bearing plates 220 and which extends through an opening 252 in the door leaf 10 (see FIG. 8). The end 88 of the spring 132 is compressed by this movement.

Figure 7C:
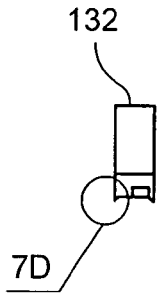
FIG. 7C is a side view of the leaf spring shown in FIG. 7A.
Figure 7A:
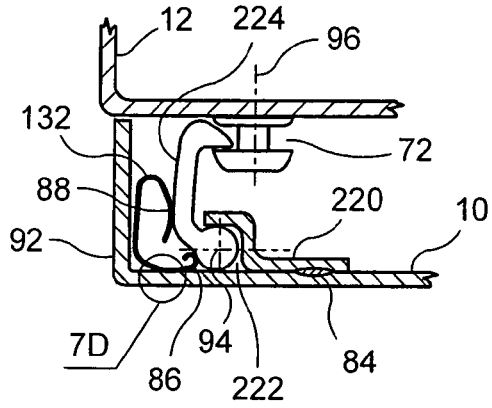
FIG. 7A is a sectional view similar to that in FIG. 1 showing a rod closure with a continuous, unfinished swiveling profile with a holding plate and return spring in the door leaf and a closing pin at the door frame, which closing pin is designed as a pivoting part.
Figure 7B:
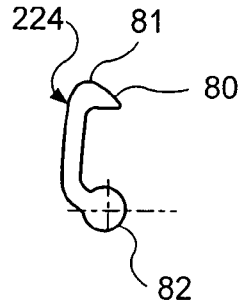
FIG. 7B is a detail showing the cross-sectional shape of the closure rod (swiveling profile)

The hook 81 of the profile 224 has an inclined surface 80 so that, in this case also, the door arrives in the closing position automatically in the manner of a latch without actuation of the swiveling profile in that the head of the closing pin 72, while sliding along on the inclined surface 80 of the hook 81, pushes the hook 81 aside and can then catch in the position shown in FIG. 7A.

Figure 7D:
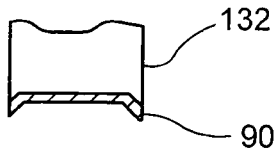
FIG. 7D is an enlarged partial view of a claw provided for the spring.

FIG. 7D differs in that claws 90 proceeding from the spring 132 press into the material of the door leaf 10 and accordingly prevent an axial displacement of the leaf spring. As was already mentioned, it is sufficient when the bearing plate 220 is arranged in some areas and, in each instance, has a length of several centimeters in axial direction.

Figure 9:
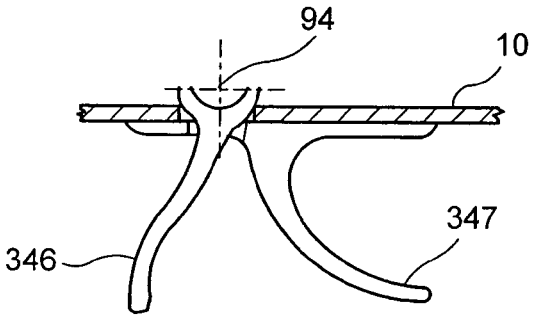
FIG. 9 is a cross-sectional view of an opener handle together with a pulling handle that is separate from the latter for actuating a right-handed door with the right hand.

The opener handle which can be clipped on the swiveling profile can also have the shape shown in FIG. 9 at reference number 346. In addition, a separate handle 347 can be arranged on the door leaf 10 to enable a reliable and stable opening of the door leaf 10. The shape shown in FIG. 9 is suitable for opening and pulling when actuating a right-handed door (hinge on the left) with the right hand.

Figure 8:
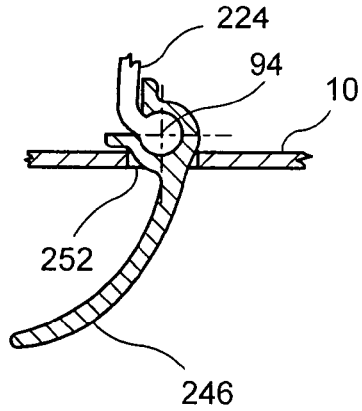
FIG. 8 is a cross-sectional view of an actuating lever or opener handle which can be clipped onto the swiveling profile.

The shape shown in FIG. 8 is carried out in such a way that the profile 224 swivels to the left automatically when pulling on the handle 246 and the door is accordingly unlocked. The door (hinge on the right) can then be pulled open.

Figure 10:
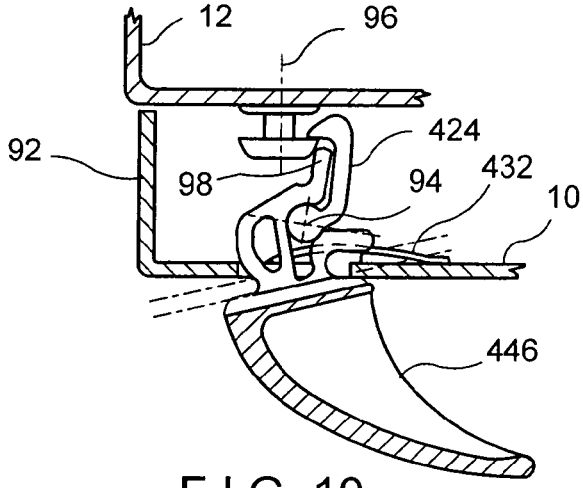
FIG. 10 is a cross-sectional view of a clip-on handle arrangement with free running, including a wire spring for the return of the handle for opening and pulling the door with the right hand.

The swiveling profile closure shown in FIGS. 7 and 8 is "pulling" and "external": "pulling" refers to the hook profile and "external" means outside the counter-closing piece 72, i.e., offset relative to the latter with respect to the door edge 92. In other words, the pivot point 94 of the profile 224 lies closer to the edge 92 of the door 10 than the axis 96 of the counterpiece 72. In the swiveling profile closure (pulling/internal) shown in FIG. 10, an attachment handle 446 is used which can be opened by means of a wire spring 432 which provides for the return of the handle; however, the hook 424 opens in the clockwise direction in this case. The handle 44 contacts the hook 424 by a projecting part 98, so that this hook 424 can move to the right independent from the projection 98, specifically when closing the door 10, so that a type of freewheel or free running is realized which allows the door 10 to be closed without actuating the handle 446.

It is clear that the pivot point 94 of the profile 424 in this case is at a greater distance from the door edge 92 than the axis 96 of the counterpiece 72.

Figure 11:
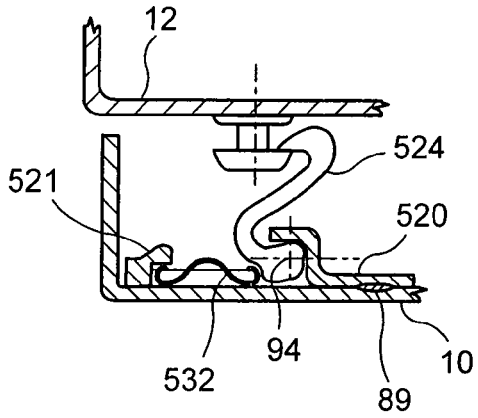
FIG. 11 is a cross-sectional view with an S-shaped swiveling profile with a hook with two-part bearing plate and leaf spring fastening.
Figure 12:
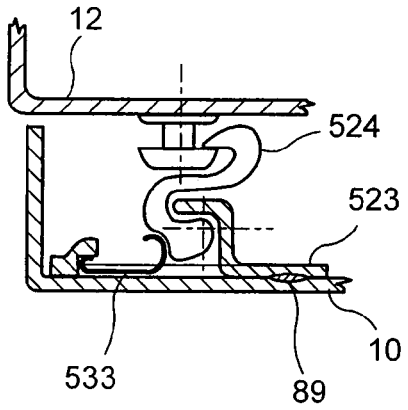
FIG. 12 is a view similar to that in FIG. 11 showing a swiveling profile closure with a one-part bearing plate and leaf spring for holding the profile and for the spring suspension of the profile.
Figure 13:
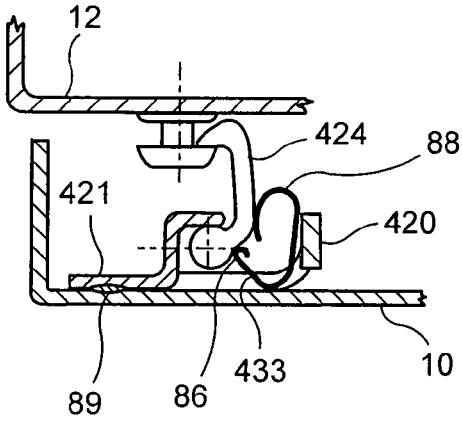
FIG. 13 is a view similar to that in FIG. 11 showing a swiveling profile closure with a bearing plate welded to the door and a leaf spring, with a springing end which serves for the springing return of the profile, and with a rigid end for holding the profile in the bearing plate, wherein a device is provided in the plate for holding the spring, the leaf spring being clipped into this device after insertion of the profile.

FIGS. 11, 12 and 13 show pulling/internal swiveling profile closures. These embodiment forms are provided for constructions in which there is limited space. In the embodiment form according to FIG. 11, a two-part bearing plate 520, 521 is provided. A leaf spring 532 holds the pivot point 94 of the swiveling profile 524 at the fixed location, but allows a limited swiveling of the hook against spring force around this pivot point. Also, in the embodiment form shown in FIG. 12 in which the bearing plate 523 comprises one part, a leaf spring 533 serves to hold the profile as well as for elastic swiveling of the swiveling profile 524 in the counterclockwise direction.

In the embodiment form shown in FIG. 13, two bearing pates 420, 421 are provided, while the swiveling profile 424 is again held by the rigid end 86 of a leaf spring 433 and a soft end 88 of the leaf spring 433 serves to restore the profile 424 to the closing position in the counterclockwise direction.

The advantage of these embodiment forms is that the leaf spring can also be clipped in after the profile is mounted.

Figure 14:
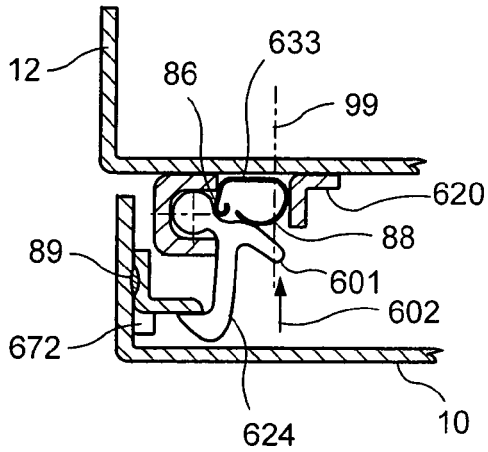
FIG. 14 shows an embodiment form in which a swiveling profile closure is provided at the door frame by means of holding plates which are arranged in some areas and are screwed to the housing, and leaf springs are provided with rigid and soft ends for holding and for returning the profile.
Figure 15:
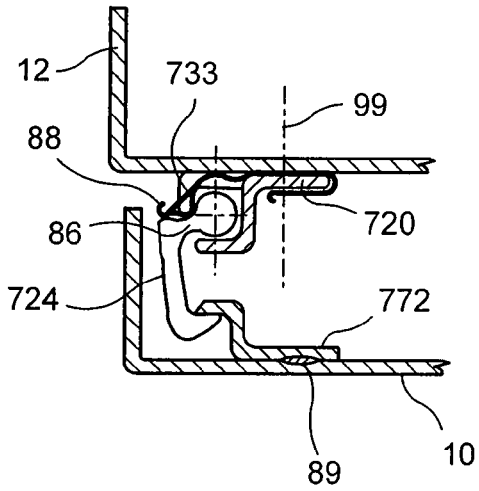
FIG. 15 shows an alternative embodiment form with respect to FIG. 14.

Embodiment forms in which holding plates 620, 720 are screwed to the housing 12 at 99 in some portions are shown in FIGS. 14 and 15. The leaf springs 633, 733 are provided with their rigid end 86 for holding the profile 624, while their soft end 88 serves for restoring. A counter-closing part 672, 772 is welded to the door in a continuous manner or by portions (see weld spot 89). The screw connection is designated by 99.

In this case, the profile 624 has an actuating projection 601 which is formed at its outer side by a U-leg and which can be pressed in the direction of arrow 602 and then opens the closure.

In contrast to the preceding embodiment forms, the profile 624, 724 in this case is not mounted at the door leaf 10, but at the housing 12. In the embodiment form shown in FIG. 15, a holding plate 720 together with the leaf spring 733 is screwed to the frame 12, and the profile 724 is held in a positive engagement by the spring part 86, while a spring part 88 arranged alongside the latter supplies the restoring force. The leaf spring 733 has a catch projection at 103 which facilitates pre-mounting of the leaf spring 733 at the holding plate 720. The counter-closing part 772 is spot welded continuously or by some portions to the door leaf 10.

The two embodiment forms according to FIG. 14 and FIG. 15 are "pulling external/internal on the housing side".

Figure 16A:
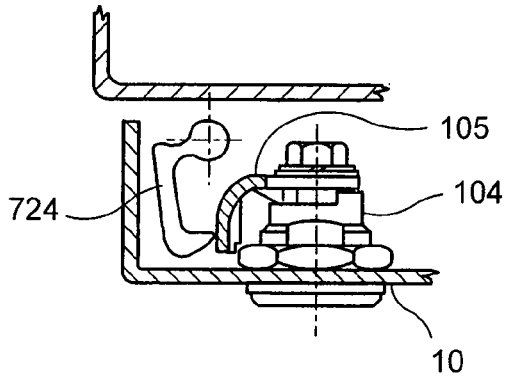
FIG. 16A shows a swiveling profile closure with actuation by the tongue of a sash closure.

FIG. 16A shows a "pulling/external" swiveling profile closure, wherein the actuation of the profile 724 is effected by means of a sash closure 104 with a special tongue 105. The tongue can be actuated in two directions and has a springing middle position.

Figure 17:
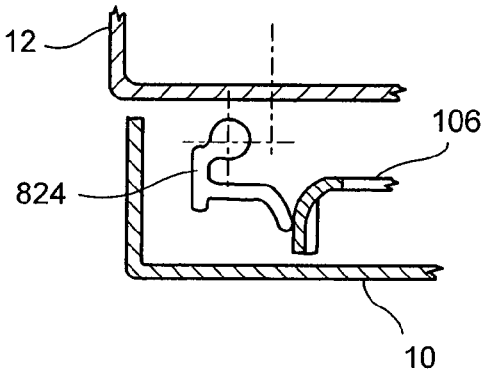
FIG. 17 also shows an actuation by means of a sash closure.

A similar embodiment form is shown in FIG. 17, where the actuation of the swiveling profile 824 is carried out by a sash lock with a tongue 106, again with actuation in two directions and with a springing middle position.

Figure 18:
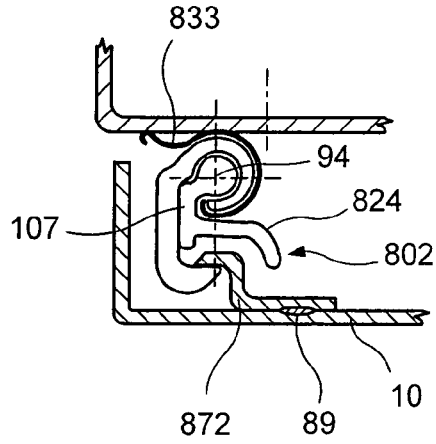
FIG. 18 shows a closure for softer doors, as they are called, with a plurality of individual lockable closure locations.
Figure 16B:
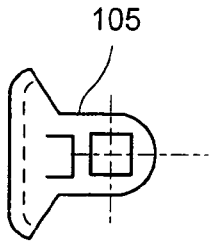
FIG. 16B shows a top view of the associated tongue.
Figure 19:
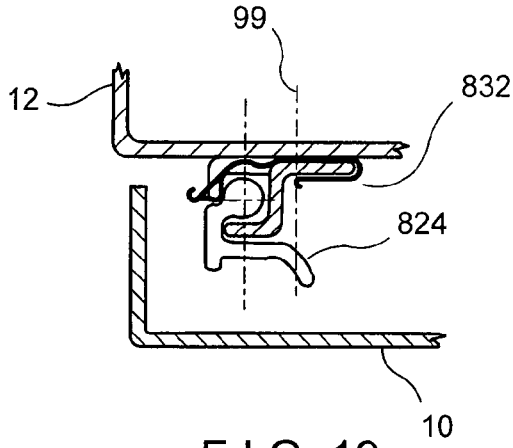
FIG. 19 shows the closure of FIG. 18 in the area of the rod bearing.

The special profile shape 824 is also shown again in FIGS. 18 and 19. The embodiment form in FIGS. 18 and 19 is particularly suitable for soft doors with a plurality of separately lockable closure points. The closure hook 107 is supported on the swiveling profile 824 by some portions with free running relative to the swiveling profile. A leaf spring 833 serves to return the hook 107 and the profile 824. The actuation for opening is carried out by exerting force in the direction of arrow 802. While the swiveling profile 824 is continuous, the counter-closing portion 872 is welded on in some portions (see reference number 89). FIG. 18 shows a section in the area of one of the plurality of closure hooks, while FIG. 19 shows the section in the area of one or more bearing plates. A catch projection is also provided at the spring 832 (see reference number 103). The bearing plate 820 is again screwed on by portions, the leaf spring 832 is clipped onto the mounting plate 820 and holds the profile 824 in the bearing plate 820.

The swiveling profile closure according to FIGS. 18 and 19 is pulling/external on the housing side, again with a free-running hook.

Figure 20:
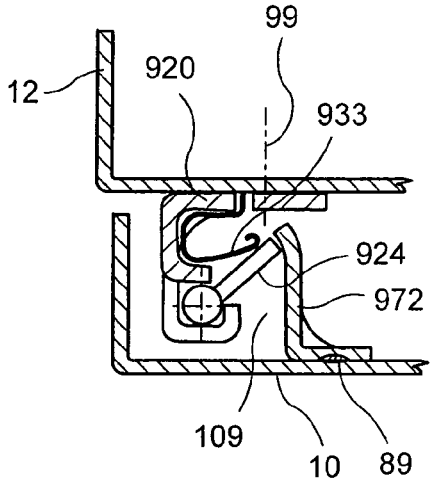
FIG. 20 shows another embodiment form.

FIG. 20 shows a swiveling profile closure in which the profile 924 comprises a straight piece and one end is mounted by means of a spherical area. A bearing plate 920 is screwed on by portions; further, the profile 924 is received in a positive engagement. A leaf spring 933 serves to restore the profile. The counter-closing part 972 is either welded continuously or by portions to the door 10. A free space for moving around is shown at 109. As a result, when the profile 924 lies at a flat angle, the loading of the counter-closing piece 972 is high when flung open (swivel lever effect). Actuation is carried out between the counter-closing part portions and acts on the profile 924.

Figure 21:
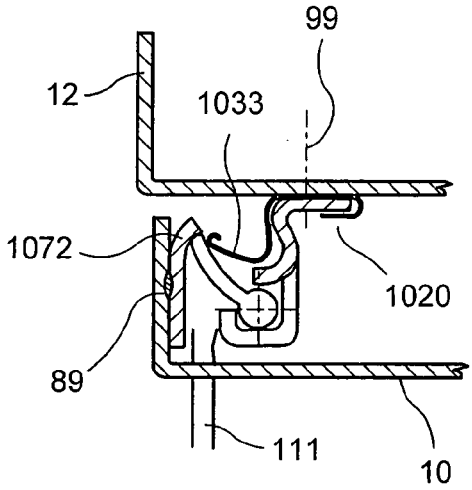
FIGS. 21, 22 and 23 show other embodiment forms.
Figure 22:
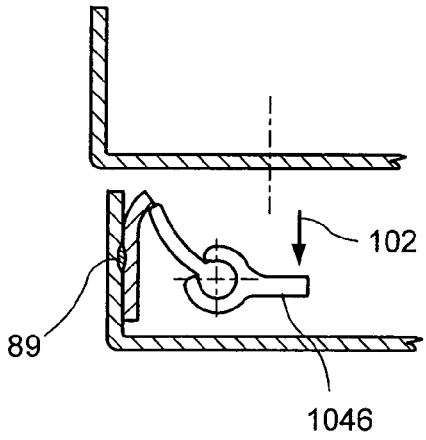
Figure 23:
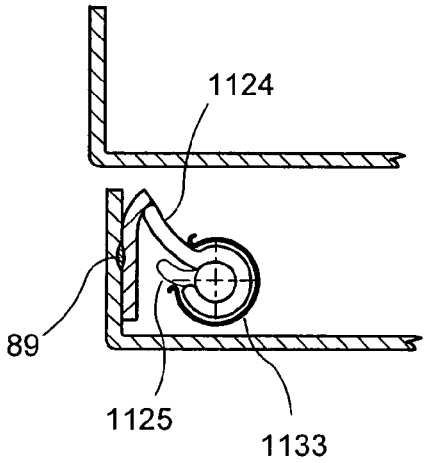

FIG. 21 shows a swiveling profile closure which abuts internally on the housing side, with a leaf spring 1033 which can be pre-mounted on the bearing plate 1020 that is screwed on by portions. The counter-closing part 1072 is welded and fastened to the door leaf 10 continuously or by portions. Because of the spacing between the parts 1072 and 1020 (reference number 111) there is a more favorable angle than in the arrangement according to FIG. 20. An actuating part 1046 (see FIG. 22) arranged between two bearing plates 1020 effects opening when pressing in the direction of the arrow 102. FIG. 23 shows a variant with locking parts 1124 in some portions with free running. A plurality of independent locking positions are possible. A leaf spring 1133 serves to restore the locking parts 1124 relative to the profile 1125. The swiveling profile 1125 is continuous and serves to support and trigger the plurality of blocking parts 1124.

The blocking part 1124 shown in the drawing is mounted on the profile 1125 in a springing manner by portions with free running. The profile can be mounted between the blocking parts as is shown with reference to FIGS. 21, 22.

Figure 24:
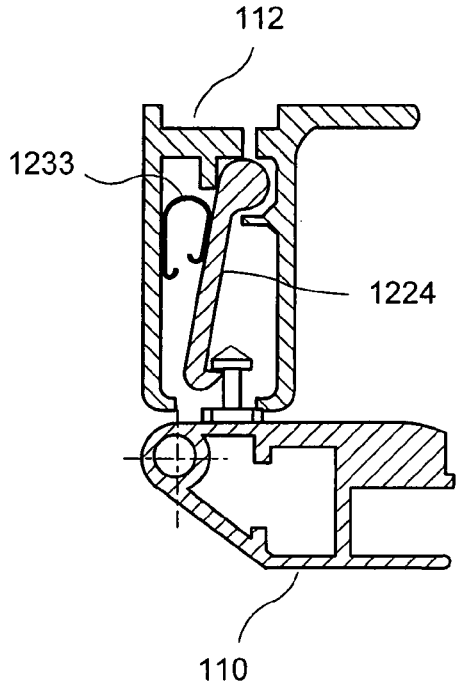
FIGS. 24 and 25 show another embodiment form.
Figure 25:
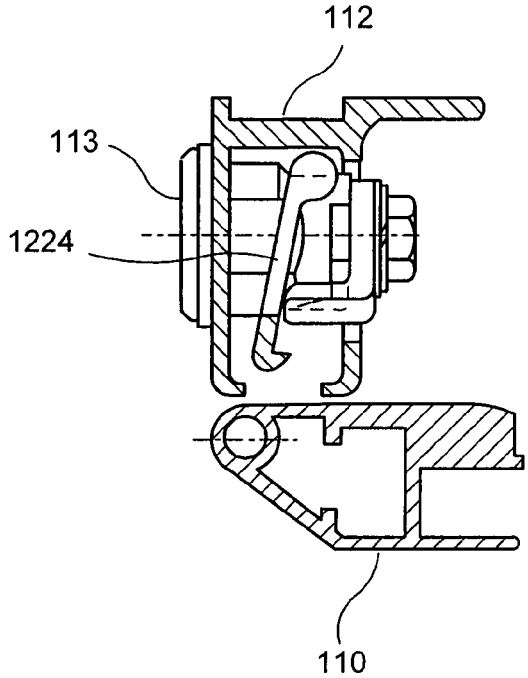

FIG. 24 and FIG. 25 show the use of the invention in special profiles. In FIG. 24, the swiveling profile 1224 is mounted in a frame profile 112 in a positive-locking manner. A leaf spring 1233 can be inserted from the front end of the profile. The counter-closing part 1272, a pivoting part, is screwed together with the door profile 110. Triggering is effected according to FIG. 25 by a sash closure 113 with special tongue so as to run on the inclined profile. The tongue can be actuated on two sides and is possible with a springing middle position. The inclined profile in FIG. 25 serves as a wedge for triggering. The profile is received only in the area of the actuation, but is otherwise closed.

The invention is commercially applicable in switch cabinet engineering.

While the foregoing description and drawings represent the present invention, it will be obvious to those skilled in the art that various changes may be made therein without departing from the true spirit and scope of the invention.

What is claimed is:

1. A rod closure for locking sheet-metal cabinet doors or doors or flaps in sheet-metal cabinet frames or door frames or housing frames, comprising:

a rod which is profiled in an elongated manner, extends substantially parallel to a door edge at the door or at the frame and is arranged in a bevel space;

a holding element which is arranged to the other of the door frame or at the door for holding the rod so as to lock the door in the closed position;

an actuating device for the rod, which actuating device is connected to a door leaf;

said rod being mounted so as to be swivelable between a locked position and an unlocked position in a rod guide element around a longitudinal axis arranged close to the side of the elongated profile directed away from a door leaf plane;

said holding element forming a contact surface for the other side of the rod facing the door leaf plane; and said actuation device engages the rod close to the side of the rod facing the door leaf, wherein the actuating device comprises a lever which passes through an opening in the door leaf and which is rigidly connected or clamped to the profiled rod.

2. The rod closure according to claim 1, wherein the profile of the rod is rectangular and forms a flat strip rod which is received in a partially circular or triangular receiving space of the rod guide element.

3. The rod closure according to claim 1, wherein the rod is injection molded from metal and/or plastic.

4. The rod closure according to claim 1, wherein the rod guide element comprises a spring device, optionally with adjustable spring force, which pushes the rod into the locked position.

5. The rod closure according to claim 1, wherein the holding element arranged at the door frame or at the door is a steel angle.

6. The rod closure according to claim 1, wherein the profiled rod is unfinished.

7. The rod closure according to claim 1, wherein the rod guide element is injection-molded plastic.

8. The rod closure according to claim 1, wherein the profiled rod has a plastic sleeve in an area of the rod bearing.

* * * * *